United States Patent [19]

Antonitsch

[11] 3,987,383

[45] Oct. 19, 1976

[54] ELECTROMAGNETIC SWITCHING DEVICE

[75] Inventor: Sepp Antonitsch, Munich, Germany

[73] Assignees: SDS-Elektro GmbH, Deisenhofen, Germany; Matsushita Electric Works Ltd., Osaka, Japan; part interest to each

[22] Filed: July 31, 1975

[21] Appl. No.: 600,808

[30] Foreign Application Priority Data

Dec. 30, 1974 Germany ..... 2461884

[52] U.S. Cl. ..... 335/78; 335/151; 335/154

[51] Int. Cl.[2] ..... H01H 51/22

[58] Field of Search ..... 335/78, 79, 80, 81, 335/82, 151, 153, 154

[56] References Cited

UNITED STATES PATENTS

| | | | |
|---|---|---|---|
| 2,993,104 | 7/1961 | Zimmer | 335/154 |
| 3,587,011 | 6/1971 | Kurz | 335/151 |
| 3,768,051 | 10/1973 | Kurpanek | 335/153 |
| 3,789,333 | 1/1974 | Kurpanek | 335/153 X |

*Primary Examiner*—George Harris
*Attorney, Agent, or Firm*—Cushman, Darby & Cushman

[57] ABSTRACT

An electromagnetic switching device comprises a bobbin with a coil mounted thereon, the bobbin forming a protective tube with a contact chamber at each end. Embedded in the bobbin are a plurality of terminals connected to the coil, pole shoes, and contact terminals connected to the pole shoes. An armature is disposed in the tube and has two free end portions coated with contact material facing end portions of the pole shoes that extend from opposite walls of a respective one of the contact chambers. At least one permanent magnet is mounted between flanges of the bobbin at each end of the tube, these magnets and the pole shoes being disposed symmetrically in relation to the longitudinal axis of the tube and at least one further axis perpendicular to such longitudinal axis.

59 Claims, 15 Drawing Figures

ELECTROMAGNETIC SWITCHING DEVICE

The present invention relates to an electromagnetic switching device having a bobbin with a coil mounted thereon, said bobbin forming a protective tube containing an armature. Contact and coil terminals, as well as pole shoes, are firmly embedded in and located by the bobbin.

The prior art, including for example U.S. Pat. No. 3,768,051 issued Oct. 23, 1973 to Waldemar Helmut Kurpanek describes arrangements in which a floating armature is disposed between two pairs of fixed contacts which are enclosed in a hermetically sealed contact enclosure. Permanent magnets are supported in a casing on opposite sides of said contact enclosure, the arrangement being such that unlike magnet poles face one another and the magnetic flux path extends through the armature. An energizing coil is arranged between these magnets. Switches of this type are operable as bistable devices and are capable of being controlled by the application of pulses thereto. However, they suffer from certain inherent drawbacks in that, for example, the use of a contact enclosure and a casing to receive the magnets results in an expensive structure. Moreover, their efficiency is relatively low, because the use of a contact enclosure results in the presence of magnetic air gaps that are of no functional use whatever. The use of bridge-like, permanent magnets, which are relatively expensive due to their specical shape, results in still another disadvantage residing in the fact that the space available for the coil or coils is reduced by the presence of the permanent magnets, thus rendering it practically impossible to increase the responsiveness by increasing the number of turns in the coil or coils.

It is a primary object of the present invention to provide an electromagnetic switching device of the aforementioned type which forms a simple and compact structure, whose manufacture is relatively problem free and which is characterized by a high efficiency. It should also be capable of being arranged for a variety of switching cycles including, for example, monostable behaviour or the assumption of a centered rest position.

To this end the invention provides an electromagnetic switching device comprising (a) a bobbin with a coil mounted thereon, said bobbin forming a protective tube with a contact chamber at each end thereof and defining a longitudinal axis, (b) said bobbin having embedded in it a plurality of terminals connected to said coil, pole shoes, and contact terminals connected to said pole shoes, (c) an armature disposed in said tube having two free end portions each coated with contact material and each facing an end portion of at least one said pole shoe coated with contact material and extending from a wall of a respective said contact chamber, and (d) at least one permanent magnet mounted between flanges of the bobbin at each end of the tube, (e) said magnets and pole shoes being disposed symmetrically in relation to said longitudinal axis and at least one further axis perpendicular to said longitudinal axis.

The use of a coil bobbin to form the protective tube and as a support for the permanent magnets, the pole shoes and the contact terminals makes it possible to provide an electromagnetic switch in which all of the magnetically effective components are accommodated within a very small space, this arrangement thus affording a reduction of losses and the attainment of high efficiency. As far as the available space is concerned, the arrangement of the invention affords considerably latitude as regards the dimensioning of the coil (or coils) and the magnets, the pole shoes being preferably disposed in the vicinity of the bobbin flanges adjacent the proximal ends of the coil (or coils), i.e. in areas in which the amount of stray flux is small.

In an embodiment of the invention, the space defined by the protective tube, the contact chambers and the magnet chambers extend throughout the length of the bobbin and remains open at both ends thereof until the permanent magnets are received in their associated chambers. Having the bobbin open at either end makes it possible to clean and/or degas the contact chambers and the interior of the protective tube in a particularly effective manner. Such a cleaning operation is necessary to remove any contaminants, the deposition of which during manufacture cannot be avoided. Such contaminants include, for example, organic deposits produced by adhesives and substances given off by the material of the bobbin.

In order that the invention may be more fully understood, embodiments thereof will now be described by way of example with reference to the accompanying drawings, in which:

FIGS. 1, 2 and 3 show three different cross sections of an embodiment of an elecromagnetic switching device in which permanent magnets supported within flanges of a coil bobbin are disposed between pole shoes on the one hand and a ferromagnetic cap-like casing on the other.

FIG. 1 being taken on I–I′ in FIG. 2, FIG. 2 on II–II′ in FIG. I and FIG. 3 on III—III in FIG. 2;

Figure 11:
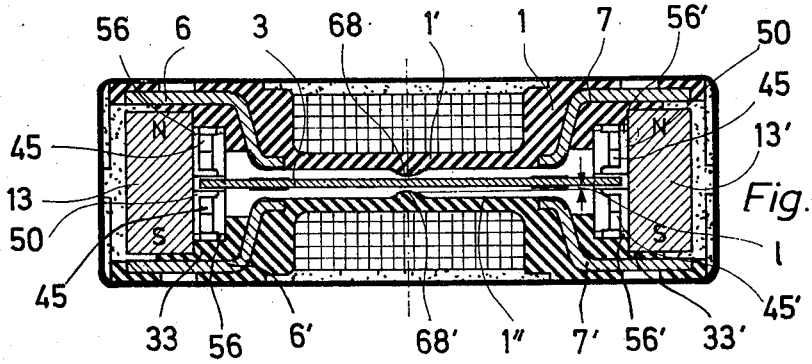
Figure 13:
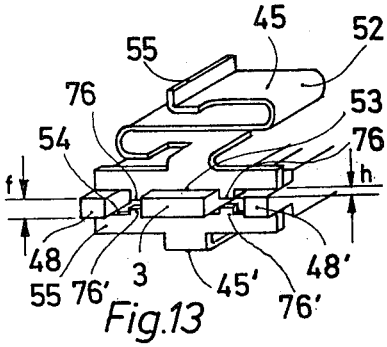
Figure 14:
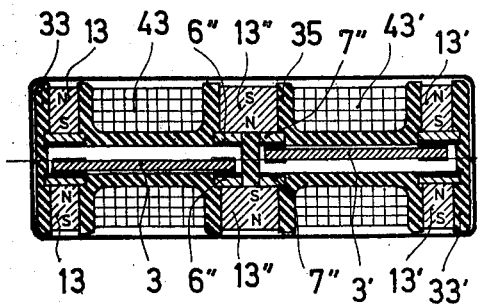
Figure 15:
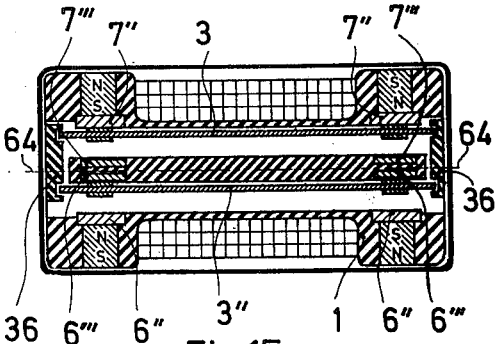

FIG. 13 is an isometric representation of two identical centering springs of the type employed in the switching device of FIG. 11; and FIGS. 14 and 15 show respective longitudinal cross sections of two different embodiments of electromagnetic switching devices either of which comprises two armatures extending parallel to the coil longitudinal axis, the armatures being aligned longitudinally in the former case and in a side-by-side relationship in the latter case.

Figure 1:
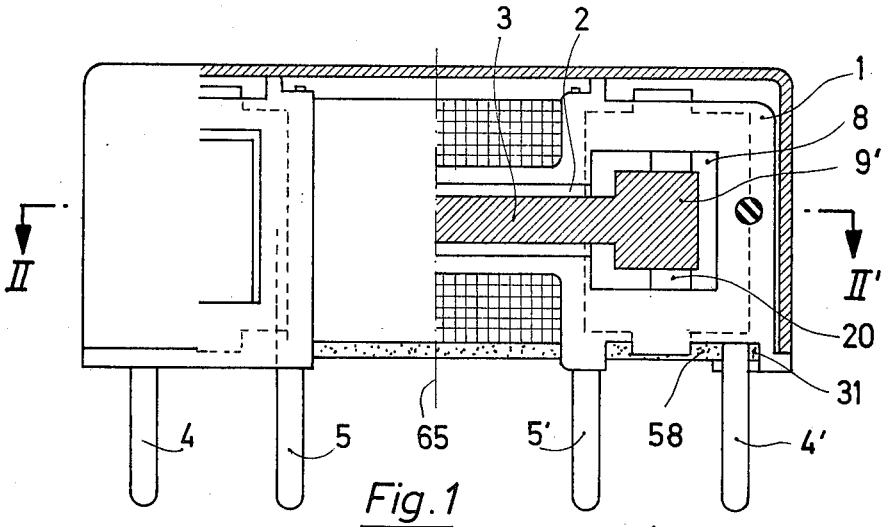
Figure 2:
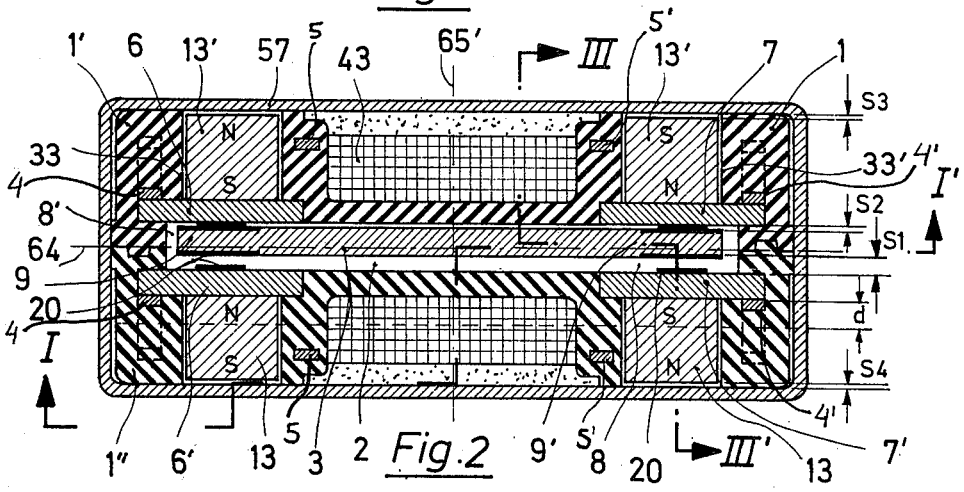
Figure 3:
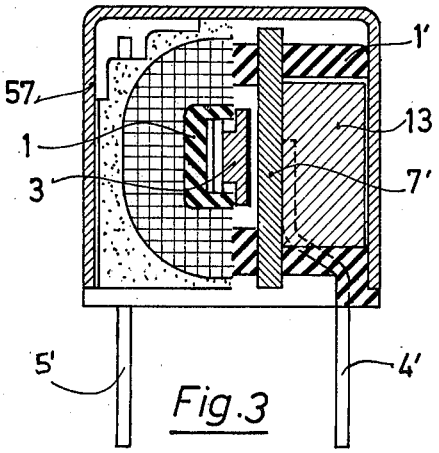

The switching device shown in FIGS. 1, 2 and 3 comprises a bobbin 1 for a coil 43, forming a protective tube 2 housing a floatingly arranged ferromagnetic armature 3 of electrically conducting material. Embedded in and positively retained by bobbin 1 are contact terminals 4, 4', coil terminals 5, 5' and pole shoes 6, 6', 7 and 7' of electrically conducting material. The free ends 9 and 9' of the armature 3 are coated on both sides with a contact material 20 and are each arranged opposite the corresponding pole shoes 6, 6', 7 and 7' in contact chambers 8 and 8' and which are also coated with a contact material 20 and connected to terminals 4, 4'. The contact chambers 8 and 8' may be constituted by chambers bordering the protective tube or may be formed as parts of the protective tube 2. Between each of the pole shoes and a ferromagnetic cap-like casing or housing can 57 there is disposed a permanent magnet 13 or 13' in an associated cavity formed in a respective bobbin flange 33 or 33', the said permanent magnets being arranged symmetrically in relation to a coil longitudinal axis 64 and in relation to at least one of two axes 65 and 65' extending at right angles in relation to axis 64 and each other. In order to avoid undesired electric bridging effects, the permanent magnets are separated from the housing can 57, e.g. by air gaps or by an insert made of electrically insulating material. In cases in which the magnets consist of a ceramic material, such a separation may be dispensed with, if desired. Upon the switching device being energized by the coil 43, the floating armature or actuator 3 will be caused to move transversely of the coil axis 64. In order to obtain this effect, the polarities of the permanent magnets 13, 13' are so selected that the permanent magnets disposed on the same side of the coil axis 64 present unlike poles to the armature 3, as shown in FIG. 2.

Due to its simple construction, the switching device is adapted to be manufactured without difficulty. The coil bobbin 1 comprises, for example, two identical halves 1' and 1'' which, before the application of the coil 43 and the insertion of the permanent magnets 13, 13', are adhesively connected together, or which are welded together by means of an ultrasonic welding process or by means of a so-called hotplate welding process in which latter the two halves are heated at their abutting faces by means of a heated plate brought into contact therewith for heating purposes, the heated plate then being removed to permit the two halves to be brought together and thus welded together. This operation will serve hermetically to seal the protective tube 2 and the contact chambers 8, 8'. The fact that all magnetically active parts are arranged as closely together as possible and that the pole shoes 6, 6', 7 and 7' extend into areas in the vicinity of the end faces of the coil 43, which areas are only subjected to small amounts of stray flux, ensures that losses are kept to a minimum and that a high efficiency is attained. A particular advantage also capable of achievement resides in the fact that the coil 43 and the permanent magnets 13, 13' can be dimensioned substantially independently of one another, thus making it possible to select the responsivity as well as the contact forces within wide ranges.

Figure 4:
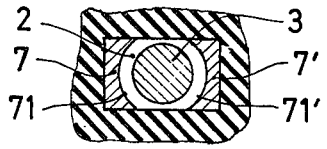
FIGS. 4 and 5 are fragmentary cross sections showing different embodiments of armatures.
Figure 5:
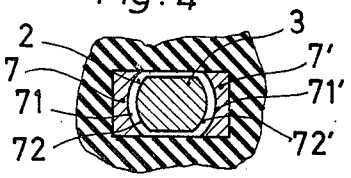

In order to obtain greater contact forces, it is possible to increase the width of the free end portions 9 and 9' of the armature 3. However, in contrast to the showing in FIGS. 1, 2 and 3 where the armature is substantially of plate-like shape and has a rectangular cross section, it is possible, as shown in FIGS. 4 and 5, to employ a rod-shaped armature 3 having a circular cross section or being provided, at the surfaces thereof that face the pole shoes 7 and 7', with part-cylindrical projections 72 and 72', the pole shoes being formed with part-cylindrical recesses 71, 71' that are complementary to the shape of the armature. An armature of this construction will center itself automatically during operation of the switching device. When the protective tube 2 is also formed in such a manner that it substantially extends only over the height of the pole shoes 7, 7', it is possible to prevent the armature 3 from entering into areas in which the spacing between the oppositely facing pole shoes is at a minimum. This feature will positively prevent the armature from undesirable bridging of the pole shoes 7 and 7' under the influence of severe shocks or vibration.

The switching device shown in FIGS. 1, 2 and 3 is characterized in that it operates as a bistable device. However, should it be desired to cause the armature always to assume a rest position on a predetermined side of the bobbin axis, i.e. to provide a monostable switching device, it is possible to select the sum $S1 + d + .S4$ (FIG. 2) of the magnetic air gaps effective with the device de-energized in such a way that this sum is approximately twice the sum of the thickness S2 of the contact material 20 on the side on which the normally closed contacts are located and the residual air gap S3 between the permanent magnets 13, 13' and the housing can 57, which latter gap is required for electrical insulation. The magnetic air gap $d$ is preferably provided for by using magnets 13 of suitably reduced dimensions as indicated in dash lines in FIG. 2. A similar effect may, however, be obtained by substituting weaker magnets for the permanent magnets 13.

Figure 6:
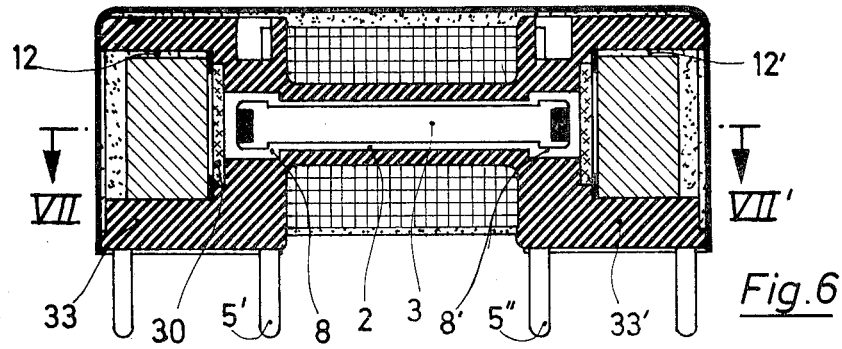
FIGS. 6 and 7 are two mutually perpendicular cross sections of an electromagnetic switching device in which permanent magnets supported within flanges of a coil bobbin are each disposed between those ends of two oppositely arranged pole shoes which are adjacent their respective terminals, FIG. 6 being taken on VI–VI′ in FIG. 7 and FIG. 7 on VII–VII′ in FIG. 6.
Figure 7:
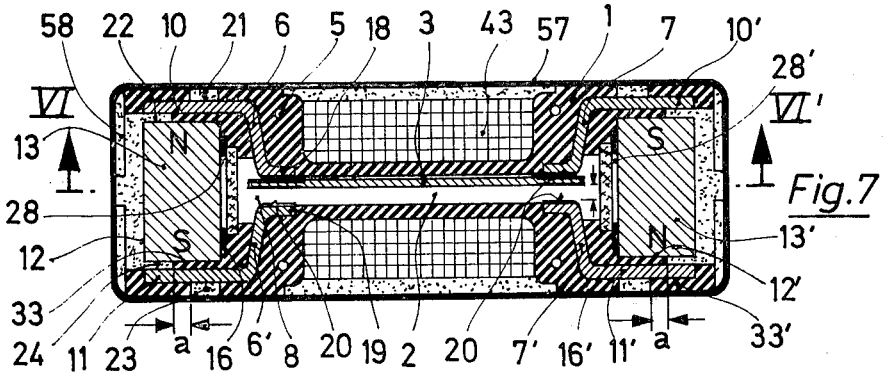

FIGS. 6 and 7 show another embodiment of an electromagnetic switching device which is also provided with a floating armature 3 and in which each of the coil bobbin flanges 33 and 33' contains a permanent magnet 13 and 13', respectively, the said magnets being disposed in magnet chambers 12 and 12' formed in the bobbin flanges in such a manner that the magnets are located between the outer end portions 10, 11, 10' and 11' of two pairs of pole shoes 6, 6', 7 and 7' which face one another. Prior to the insertion of the permanent magnets 13 and 13', the coil bobbin 1 is completely penetrated by a cavity formed by the protective tube 2, the contact chambers 8, 8' and the magnet chambers 12, 12', so that the contact material 20 and all wall surfaces of said cavity are particularly easily accessible for a cleaning operation which is performed, for example, in an ultrasonic cleaning bath. Within the flanges 33 and 33' of the coil bobbin, the portions of the pole shoes, 6, 7 which extend from the side walls of the contact chambers are angularly bent towards the center of the relay, and these bent portions 18, 19 which extend parallel to one another and to the logitudinal axis of the bobbin and which are provided with contact material 20 rolled into or unto such portions are embedded for positive location in the material of the bobbin. Upon completion of the cleaning operation, the contact chambers 8, 8' are closed by inserting the permanent magnets 13, 13' into the bobbin flanges 33 and 33' and are hermetically sealed at the associated supporting surfaces 16, 16' preferably with the aid of foils 28, 28' having both sides thereof coated with an adhesive and being dimensioned in such a manner that they substantially extend over the corresponding peripheral portions only of the permanent magnets. The pole shoes 6, 6', 7, 7' embedded in the bobbin flanges 33, 33' are provided on opposite sides with exposed portions 21, 22, 23 and 24 arranged in pairs and, as shown in FIG. 7, mutually offset by a distance *a*. The provision of such exposed portions and the spacings *a* are necessary in order accurately to provide the desired distance between the bent portions 18, 19 of the pole shoes 6, 7 which are provided with contact material 20 during the embedding operation, i.e. during the injection, pressing or press molding operation. At the exposed portions 21, 23 of pole shoes 6, 7 there will come into action, during the embedding operation, laterally movable slide members of the manufacturing tool, said slide members acting via the exposed portions 22, 24 and 18, 19 of the pole shoes on a punch-like tool which is inserted endwise and the function of which is accurately to determine the profiles of the contact chamber 8 and of the magnet chamber 12 and also the distance between the two angularly bent end portions 18, 19 of the pole shoes 6, 7, the said distance contributing to the attainment of the desired distance between the contacts.

After the bobbin 1 has been provided with the coil 43 and such coil is connected to the coil terminals 5', 5'', the switching device is simultaneously subject to a vacuum of about $10^{-5}$ torr and a temperature between 100° and 150°C in order to drive off all moisture retained in crystalline form. At the same time it is possible to activate as getters the permanent magnets 13, 13' made of barium ferrite or rare earths. Finally, a protective gas filling which is at a normal pressure of about 760 torr is substituted for the vacuum, and the protective tube 2 as well as the contact chambers 8, 8' are closed in the described manner by means of the permanent magnets.

For the purpose of providing a magnetic screening effect and of increasing the magnetic efficiency, the switching device is provided with a housing can 57 made of a ferromagnetic material which is retained in position by means of a potting compound such as a casting resin, this arrangement affording the advantage that the sealing effect as well as the mechanical and functional stability of the relay is improved to a considerably extent. In cases in which the bobbin 1 is made of a thermoplastic material, it is convenient, as shown in FIG. 1, to provide recesses 31 surrounding the contact terminals 4, 4' and the coil terminals 5, 5', such recesses being at least partly filled with the potting compound 58, in view of the fact that such compound is less susceptible to deformation than the thermoplastic materials and that it thus ensures the maintenance of the accuracy of the contact and coil terminals even in the event of a certain degree of overheating during soldering operations.

Since there exists the risk that in certain cases the getter action of the activated permanent magnets 13, 13' might prove insufficient, and since it is necessary anyway to provide for a certain spacing between the permanent magnets and the pole faces, there is provided therebetween an additional space 30 (FIG. 6) adapted to accommodate getters of a special type or molecular sieves. Instead of inserting a getter in this manner it is also possible to provide a coating of a getter material on the inner walls of the coil bobbin serving as a protective tube, this coating being applied, for example, by evaporation, as employed in the case of electronic tubes. Such measures are adapted to prevent the release of gases by the plastic materials used and thus enhance the dependability of the contacts.

Figure 8:
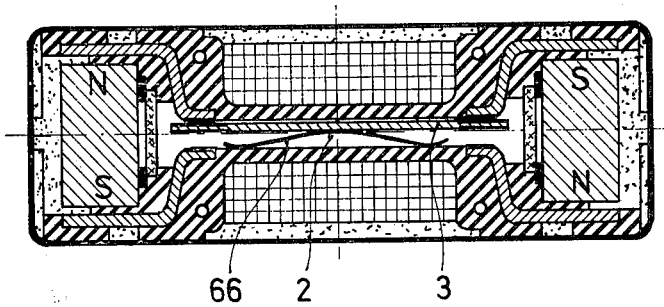
FIGS. 8 and 9 are respective longitudinal cross sections of two different electromagnetic switching devices each of which includes a spring-urged armature.
Figure 9:
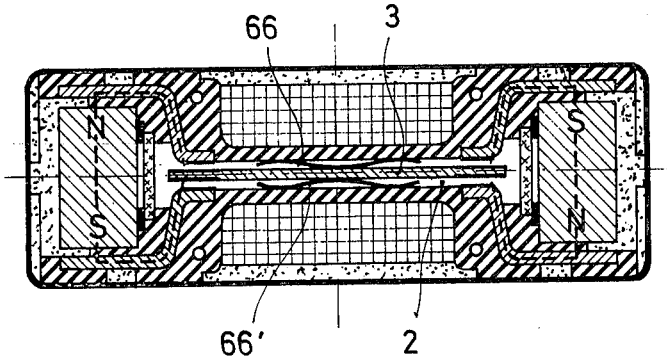

FIGS. 8 and 9 show two different embodiments of electromagnetic switching devices each comprising a single-piece bobbin of the type shown in FIGS. 6 and 7 but provided with an armature 3 of the spring-urged type disposed within a protective tube 2. The armature 3 of FIG. 8 has secured to one side thereof a leaf spring 66, whereas the armature 3 of FIG. 9 has secured to opposite sides thereof two leaf springs 66 and 66', the spring or springs in each case extending the entire length of the protective tube and being preloaded against the inner wall of the protective tube. Such spring or springs make it possible, besides retaining the armature 3 against tilting under severe shocks, to influence the manner of operation of the relay. If in the embodiment of FIG. 8 the force exerted by the leaf spring 66 predominates over the forces exerted by the permanent magnets, the relay will operate as a monostable device. In the embodiment of FIG. 9 the leaf springs 66, 66' may be sufficiently weak, the result being that bistable operation of the device is retained.

Figure 10:
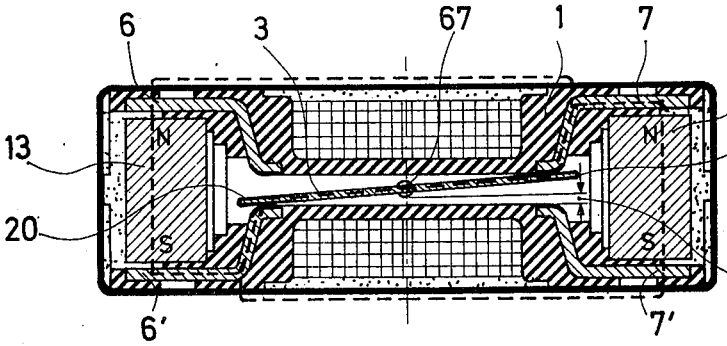
FIGS. 10 and 11 are respective longitudinal cross sections of two different electromagnetic switching devices in which the armature is supported by pivot means or by knife edge means, respectively, the armature of the device of FIG. 11 being maintained in its neutral or rest position by centering spring means.

FIGS. 10 and 11 show two different embodiments of the invention in which the armature 3 is pivoted about a transverse axis upon the solenoid coil being energized. To permit such a mode of operation, there is provided intermediate the ends of the armature a pivot or knife edge bearing. In these two embodiments, the poles of the permanent magnets 13, 13' are arranged in such a manner that the pole shoes 6, 7 and 6', 7', respectively, which are located on the same side of the bobbin axis are of like polarity. In the bistable magnet system of FIG. 10, the end portions of the armature 3 which are provided with contact material 20 engage diametrically opposed pole shoes 6' and 7. For the purpose of supporting the armature 3 for rotation, said armature is provided with a pivot pin 67 secured thereto and supported in matching apertures in the wall of the protective tube 2. In the case of the bobbin 1 of FIG. 11 which is comprised of two identical halves 1' and 1'', it is possible to provide a knife-edge bearing in a particularly economical manner. Diametrically opposed portions of the inner wall of the protective tube 2 are provided with transverse ridges 68 and 68' between which the armature 3 is located with a clearance *l* being provided.

Figure 12:
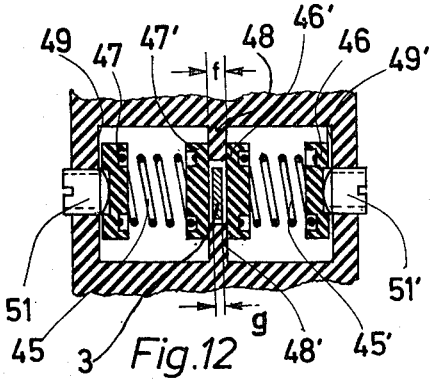
FIG. 12 is a fragmentary cross section illustrating the function of centering springs.

Another feature of the switching device of FIG. 11 resides in the fact that the armature 3, in the absence of energization of the coil, is held in a neutral centralized position which is determined by two pairs of centering springs 45, 45' disposed on opposite sides of the armature. For the purpose of supporting the centering springs there are provided on opposite sides of the armature 3, as shown in FIG. 12, supporting plates 46', 47', engaging the diagrammatically opposed centering springs 45, 45' and being urged thereby against nose-like projections 48 and 48'. The opposite ends of the centering springs 45, 45' cooperate with additional supporting plates 46, 47 which, in turn, are in engagement with the side walls 49, 49' of the bobbin 1 or with adjusting means such as adjusting screws 51 and 51'. In the present case if it convenient to make the width *f* of the nose-like projections 48, 48' slightly greater than the thickness *g* of the armature 3 as shown in FIG. 12. A suitable embodiment of the centering springs 45, 45' is shown isometrically in FIG. 13, whereas FIG. 12 shows such springs in their assembled condition. The centering springs are formed as substantially S-shaped leaf springs 52 and 52', one pair of such springs being associated with each of the ends of the armature 3. The springs 52, 52' are provided at their ends with flanges 55, 55' extending at right angles thereto and perpendicularly to each other, such flanges serving the function of the supporting plates 46, 46' of FIG. 12. Formed in the side walls 49, 49' of the space 50 accommodating the centering springs are grooves 56, 56' receiving the flanges 55 of the centering springs. A centering spring of the type just described need only be dropped into the space 50 provided therefor (FIG. 13), because its inelastic flange 55 which has a slightly greater width serves to locate the spring in a lateral direction in relation to the inner walls of the bobbin flanges 33, 33' and the permanent magnets 13, 13'. In addition to this, the centering springs 45, 45' are formed at their margins 53, 54 facing the armature 3 with noses 76, 76' which straddle the armature with a clearance, the vertical length *h* of which is smaller than one-half of the thickness *f* of the noses 48, 48' (FIG. 13). This arrangement provides in a simple manner for lateral guidance of the armature 3 with the centering springs being incapable of influencing one another.

FIGS. 14 and 15 show two further different embodiments of switching devices; in the device of FIG. 14, there are provided two armatures 3 and 3' which extend parallel to the bobbin axis 64 and which are aligned longitudinally; in the device of FIG. 15, there are provided two armatures 3 and 3'' also extending parallel to the bobbin axis 64 but disposed in side-by-side relationship; the embodiments of FIGS. 14 and 15 are examples of simple devices provided with multiple contacts. In the case of the longitudinally aligned armatures 3, 3', the bobbin is provided, intermediate its ends, with a third bobbin flange 35 in which permanent magnets 13'' are mounted. Since these permanent magnets act on either of the armatures 3 and 3', they are provided with electrically separated pole shoes 6'' and 7'', and they are arranged in such a manner that their poles facing the bobbin axis 64 are opposed to the poles of the permanent magnets 13, 13' in the terminal bobbin flanges 33, 33' which are located on the same side of the bobbin axis 64. If a single energizing coil 43 is used, the armatures 3, 3' will be moved in opposite directions upon energization of the device. However, it is possible in this embodiment to employ two separate energizing coils 43, 43' and thus independently to control each of the armatures 3 and 3'. In the embodiment of FIG. 15, however, in which a non-compartmented coil space is provided facilitating the incorporation of the coil, the two armatures disposed side by side will always be operated unidirectionally and in synchronism. Also in this case it is possible, in comparision with a single-contact arrangement, to reduce the number of permanent magnets required. For this purpose it is possible, for example, to arrange between the armatures 3 and 3'', which are disposed side by side, permanent magnets supported in bobbin 1 in alignment with bobbin axis 64, such magnets being provided, on both sides, with pole shoes 6''', 7'''. Alternatively, as shown in FIG. 15, there may be embedded in coil bobbin 1 guide plates which are aligned with bobbin axis 64 and which serve the function of pole shoes 6''' and 7'''. Since the armatures will always be moved unidirectionally, it is also possible, in the case of the two armatures 3, 3'' arranged side by side, to provide a mechanical connection therebetween which allows freedom in two directions with the electric separation of the armatures being retained. For this purpose, use is preferably made of insulating members 36 straddling the respective ends of the armatures 3, 3'' and ensuring that any undesirable bridging of opposed pole shoes 6'', 6''' or 7'', 7''' by the armatures 3, 3'' is avoided in cases in which the device is subjected to severe shocks. Still another advantage of the embodiments of FIGS. 14 and 15 resides in the fact that the combination of features thereof will enable the number of contacts to be increased still further.

What is claimed is:

1. An electromagnetic switching device comprising a. a bobbin with a coil mounted thereon, said bobbin forming a protective tube with a contact chamber at each end thereof and defining a longitudinal axis, b. said bobbin having embedded in it a plurality of terminals connected to said coil, pole shoes, and contact terminals connected to said pole shoes, c. an armature disposed in said tube having two free end portions each coated with contact material and each facing an end portion of at least one said pole shoe coated with contact material and extending from a wall of a respective said contact chamber, and d. at least one permanent magnet mounted between flanges of the bobbin at each end of the tube, e. said magnets and pole shoes being disposed symmetrically in relation to said longitudinal axis and at least one further axis perpendicular to said longitudinal axis.

2. The electromagnetic switching device of claim 1, wherein each free end portion of the armature faces end portions of a pair of said pole shoes extending from opposite walls of the respective contact chamber.

3. The electromagnetic switching device of claim 1, wherein a said permanent magnet is disposed between each said pole shoe and a ferromagnetic housing can, each said permanent magnet being within a said flange of said bobbin in a magnet chamber formed in said flange and shaped to match the shape of the permanent magnet.

4. The electromagnetic switching device of claim 1, wherein a said permanent magnet is disposed in each flange of said bobbin between outer end portions of two opposed said pole shoes in a magnet chamber formed therefor in said bobbin.

5. The electromagnetic switching device of claim 4, wherein said bobbin is penetrated throughout its length by a cavity formed by said protective tube, said contact chambers and said magnet chambers, both ends of said cavity being open prior to insertion of said permanent magnets.

6. An electromagnetic switching device according to claim 1 wherein said armature is floatingly arranged within said protective tube.

7. An electromagnetic switching device according to claim 1, wherein said armature is located within said protective tube by spring means.

8. The electromagnetic switching device of claim 7, wherein said armature has secured thereto intermediate its ends on at least one side thereof at least one leaf spring extending substantially the length of said protective tube and bearing with preloading against an inner wall of said protective tube.

9. An electromagnetic switching device according to claim 1, including pivot bearing means for said armature intermediate the ends of said armature.

10. The electromagnetic switching device of claim 9, wherein said armature has attached thereto a substantially cylindrical pivot pin supported for rotation in said protective tube in such a manner as to provide a predetermined clearance.

11. The electromagnetic switching device of claim 9, wherein said protective tube is formed on opposing portions of its inner wall with ridge-like projections, said armature extending between such projections with a clearance between said armature and said projections.

12. An electromagnetic switching device according to claim 1, wherein said armature has the shape of an elongated lamella of rectangular cross section.

13. The electromagnetic switching device of claim 12, wherein the end portions of said armature are of greater width than an intermediate portion thereof.

14. An electromagnetic switching device according to claim 1, wherein said armature is formed as a rod having a circular cross section and that said pole shoes are each provided with a part-cylindrical recess the shape of which substantially matches the shape of said armature.

15. An electromagnetic switching device according to claim 1, wherein said armature has the shape of a rod, the surfaces thereof facing said pole shoes being provided with part-cylindrical projections and said pole shoes being provided with part-cylindrical concave recesses substantially corresponding in shape with said part-cylindrical projections.

16. The electromagnetic switching device of claim 13 or claim 15, wherein said protective tube defines a cavity which has a dimension in the chordal direction of said part-cylindrical recesses of said pole shoes which is substantially equal to the chordal dimension of said recesses.

17. An electromagnetic switching device according to claim 1, wherein said pole shoes extend from opposed inner walls of their respective contact chamber, and are angularly bent towards the longitudinal axis of the bobbin at transitions between said contact chambers and said protective tube, said bent portions of said pole shoes extending parallel to said armature into the vicinity of the associated ends of the chamber, and the free end portions of said armature and the angularly bent portions of said pole shoes being coated with the contact material within the overlapping areas thereof.

18. The electromagnetic switching device of claim 17, wherein said angularly bent portion of at least one of said pole shoes and the free end portion of said armature facing said pole shoes are provided with contact material secured thereto by rolling thereof into or onto the respective parts.

19. The electromagnetic switching device of claim 17, wherein the pole shoes are welded to their associated contact terminals before being embedded in the bobbin.

20. An electromagnetic switching device according to claim 17, wherein outer end portions of said pole shoes facing said permanent magnets are embedded in walls of their associated magnet chambers in such a manner as to leave exposed free portions on opposite sides thereof, said free portions being offset in relation to one another by a predetermined distance, and the said free portions include portions which are disposed in said magnet chambers in the vicinity of end faces of said bobbin.

21. An electromagnetic switching device according to claim 1, wherein said bobbin is comprised of two positively engageable halves made of a plastic material and capable of being welded together, and wherein for the purpose of welding such bobbin halves together a deformation of the material thereof has been caused only in a welding zone under the influence of energy and wherein at least one of said bobbin halves is formed in a plane along which such halves are connected together with rib-like projection, and wherein during the welding operation an assembly gauge adapted to determine the spacing of adjacent contacts and the distance to be traveled by said armature was disposed between opposed end portions of said pole shoes covered with contact material and between said bobbin halves.

22. An electromagnetic switching device according to claim 1 wherein the spacing between said end portions of said pole shoes that are coated with contact material is of such a magnitude that when the switching device is de-energized the armature is adapted to remain lifted off the pole shoes and to be maintained in a centered position therebeween.

23. The electromagnetic switching device of claim 22, wherein when the switching device is de-energized, said centered position of the armature is determined by two centering springs disposed on opposite sides of the armature.

24. The electromagnetic switching device of claim 23, wherein said centering springs are supported with preloading at their ends directly at nose-like projections on the one hand and at side walls on the other, which side walls are walls of the space housing said springs.

25. The electromagnetic switching device of claim 24, wherein supporting forces exerted by said centering springs are adapted to be independently adjustable by means of adjusting members adapted to displace the supporting plates supported by the side walls of the space housing said centering springs.

26. An electromagnetic switching device according to claim 23, wherein said centering springs are formed as spiral springs.

27. An electromagnetic switching device according to claim 23, wherein said centering springs are formed as substantially S-shaped leaf springs and are arranged in the vicinity of the free ends of said armature.

28. An electromagnetic switching device according to claim 24, including mutually aligned nose-like projections on opposite sides of said armature, said projections being disposed in a plane defined by the centered position of said armature.

29. An electromagnetic switching device according to claim 28, wherein the thickness of said nose-like projections as measured in the direction of the forces exerted by said centering springs slightly exceeds the thickness of said armature in the same direction.

30. An electromagnetic switching device according to claim 28, wherein the end portions of said centering springs are bent at right angles in relation to the bodies thereof in such a manner that their end faces bear against the side walls of the space housing them as well as against said nose-like projections or said armature.

31. The electromagnetic switching device of claim 30, wherein said end faces of said centering springs bearing against said armature are formed with noses straddling said armature with a predetermined clearance, and wherein the height of said nose is smaller than one-half of the thickness of said nose-like projections.

32. The electromagnetic switching device of claim 30, wherein said end portions of each centering spring which are bent at right angles in relation to the bodies thereof are disposed at right angles in relation to one another.

33. An electromagnetic switching device according to claim 30, wherein each of the side walls of the space housing said centering springs is formed with a groove adapted to receive the corresponding bent end portion of the centering spring associated therewith.

34. An electromagnetic switching device according to claim 23, wherein with any contacts of the device closed the actuating forces exerted by said permanent magnets are smaller than the spring forces that said centering springs exert due to their preloading.

35. An electromagnetic switching device according to claim 1, wherein the switching device is surrounded by a ferromagnetic housing can adapted to conduct magnetic flux of said permanent magnets.

36. The electromagnetic switching device of claim 35, wherein, for the purpose of adapting the device normally to assume a rest position on one side of its longitudinal axis, the sum of magnetic air gaps with the device in its de-energized condition, is approximately twice as large as the sum of residual air gaps determined by the thickness of said contact material and the spacing required for electric insulation between said permanent magnets on the one hand and said housing can or said yoke members on the other hand.

37. The electromagnetic switching device of claim 36, wherein one of said magnetic air gaps is determined by the fact that on the side opposite the side on which the normally closed contacts are disposed there are arranged permanent magnets which are smaller than the permanent magnets arranged on the side on which the normally closed contacts are located.

38. An electromagnetic switching device according to claim 1, wherein two said armatures are disposed within said bobbin said armatures being co-axially aligned and extending parallel to the longitudinal axis of said bobbin.

39. The electromagnetic switching device of claim 38, wherein there are provided in association with the ends of said two co-axially aligned armatures two common permanent magnets and electrically separated pairs of pole shoes.

40. An electromagnetic switching device according to claim 1, wherein two said armatures are disposed within said bobbin, said armatures extending parallel to the longitudinal axis of said bobbin and arranged in side-by-side relationship.

41. The electromagnetic switching device of claim 40, wherein there is disposed between said armatures arranged in side-by-side relationship a plurality of permanent magnets supported by said bobbin, aligned with the longitudinal axis of said bobbin and provided on opposite sides with pole shoes.

42. The electromagnetic switching device of claim 40, wherein embedded in said bobbin between said armature disposed in side-by-side relationship, are guiding plates which are aligned in the direction of the longitudinal axis of said bobbin and are adapted to function as pole shoes.

43. An electromagnetic switching device according to claim 40, wherein said armatures arranged in side-by-side relationship, while being electrically insulated from one another, are mechanically interconnected in a manner providing for two limited degrees of freedom.

44. An electromagnetic switching device according to claim 1, wherein, between each contact chamber and magnet chamber associated therewith, there is a supporting surface adapted for adhesive connection thereto of a substantially parallelepiped-shaped permanent magnet in turn adapted sealingly to close its associated contact chamber.

45. An electromagnetic switching device according to claim 1, wherein each permanent magnet is housed in an associated magnet chamber bordering on said contact chamber and is made of barium ferrite and is activated to be adapted to act as a getter.

46. An electromagnetic switching device according to claim 44, wherein said permanent magnets are attached to said supporting surfaces provided in said contact chambers by means of foil pieces which are coated with adhesive on both sides thereof, such foil pieces being cut to shape in such a manner as substantially to extend over border areas of said permanent magnets.

47. An electromagnetic switching device according to claim 1, wherein between said contact chambers and magnet chambers there are spaces adapted to receive additional getter material.

48. The electromagnetic switching device of claim 47, wherein each additional quantity of getter material and each permanent magnet is fixed in position by a thermally induced deformation of terminal wall areas of said bobbin made of plastic material.

49. An electromagnetic switching device according to claim 1, wherein walls of said contact chambers are coated with getter material.

50. An electromagnetic switching device according to claim 1, wherein an under side of said bobbin has formed therein recesses surrounding said contact terminals and said coil terminals and at least partially filled with casting resin.

51. An electromagnetic switching device according to claim 1, wherein the space between said bobbin and a housing can is filled with a potting material.

52. An electromagnetic switching device according to claim 1, including knife-edge bearing means for said armature intermediate the ends of said armature.

53. An electromagnetic switching device according to claim 1, wherein said bobbin is comprised of two positively engageable halves made of a plastic material and capable of being welded together, and wherein for the purpose of welding such bobbin halves together a deformation of the material thereof has been caused only in a welding zone under the influence of energy, and wherein a first bobbin half is formed in said plane with a rib-like projection, a second bobbin half being provided with a groove matching said projection, and wherein during the welding operation an assembly gauge adapted to determine the spacing of adjacent contacts and the distance to be traveled by said armature was disposed between opposed end portions of said pole shoes covered with contact material and between said bobbin halves.

54. The electromagnetic switching device of claim 23, wherein said centering springs are supported with pre-loading at their ends by means of supporting plates at nose-like projections on the one hand and at side walls on the other, which side walls are walls of the space housing said springs.

55. An electromagnetic switching device according to claim 23, wherein said centering springs are formed as helical springs.

56. An electromagnetic switching device according to claim 1, wherein yoke members are disposed between ends of said permanent magnets housed in the flanges of said bobbin that face away from said pole shoes.

57. The electromagnetic switching device of claim 36, wherein one of said magnetic air gaps is determined by the fact that on the side opposite the side on which the normally closed contacts are disposed there are arranged permanent magnets which are weaker than the permanent magnets arranged on the side on which the normally closed contacts are located.

58. An electromagnetic switching device according to claim 1, wherein each permanent magnet is housed in an associated magnet chamber bordering on said contact chamber and is made of one of the rare earths and is activated to be adapted to act as a getter.

59. An electromagnetic switching device according to claim 1, wherein walls of said protective tube are coated with getter material.

* * * * *